United States Patent [19]

Terauchi

[11] Patent Number: 4,632,640

[45] Date of Patent: Dec. 30, 1986

[54] WOBBLE PLATE TYPE COMPRESSOR WITH A CAPACITY ADJUSTING MECHANISM

[75] Inventor: Kiyoshi Terauchi, Gunma, Japan

[73] Assignee: Sanden Corporation, Gunma, Japan

[21] Appl. No.: 703,902

[22] Filed: Feb. 21, 1985

[30] Foreign Application Priority Data

Feb. 21, 1984 [JP] Japan ..... 59-29653

[51] Int. Cl.[4] ..... F04B 1/12

[52] U.S. Cl. ..... 417/269; 417/222

[58] Field of Search ..... 417/269, 270, 222; 92/12.2

[56] References Cited

U.S. PATENT DOCUMENTS

| | | | |
|---|---|---|---|
| Re. 27,844 | 12/1973 | Olson | 417/269 |
| 2,964,234 | 12/1960 | Loomis III | 74/60 |
| 3,376,822 | 4/1968 | Leduc et al. | 92/12.2 |
| 3,861,829 | 1/1975 | Roberts et al. | 417/270 X |
| 4,073,603 | 2/1978 | Abendschein | 417/270 X |
| 4,145,163 | 3/1979 | Fogelberg et al. | 417/222 |
| 4,174,191 | 11/1979 | Roberts | 417/269 X |
| 4,428,718 | 1/1984 | Skinnoi | 417/270 |
| 4,475,871 | 10/1984 | Roberts | 417/270 X |

FOREIGN PATENT DOCUMENTS

| | | | |
|---|---|---|---|
| 1906226 | 10/1969 | Fed. Rep. of Germany | 417/222 |
| 809826 | 3/1937 | France | 417/269 |
| 585940 | 11/1958 | Italy | 417/270 |
| 530595 | 12/1946 | United Kingdom | 417/269 |
| 865876 | 4/1961 | United Kingdom | 417/222 |

*Primary Examiner*—Carlton R. Croyle
*Assistant Examiner*—Paul F. Neils
*Attorney, Agent, or Firm*—Banner, Birch, McKie & Beckett

[57] ABSTRACT

A reciprocating piston type refrigerant compressor includes a compressor housing having a cylinder block provided with a plurality of cylinders and crank chamber adjacent the cylinder block. A piston slides within each of cylinders and is reciprocated by a wobble plate driven by a cam rotor mounted on a drive shaft. The cam rotor comprises a rotor plate fixed on an inner terminal end of a drive shaft and slant plate with a sloping surface in close proximity to the wobble plate. The slant plate is hinged to the rotor plate for adjusting the slant angle thereof in response to change of pressure in the crank chamber. The pressure in the crank chamber is controlled by controlling communication between the crank chamber and the suction chamber. The wobble plate is supported for a nutational motion on a ball element which is disposed on supporting element slidably carried in the cylinder block to maintain the wobbling center thereof on the center of the ball element.

8 Claims, 2 Drawing Figures

WOBBLE PLATE TYPE COMPRESSOR WITH A CAPACITY ADJUSTING MECHANISM

TECHNICAL FIELD

The present invention relates to a refrigerant compressor, and more particularly, to a wobble plate type compressor for an air conditioning system in which the compressor includes a mechanism for adjusting the capacity of the compressor.

BACKGROUND OF THE INVENTION

Generally, in air conditioning apparatus, thermal control is accomplished by intermittent operation of the compressor in response to a signal from a thermostat located in the room being cooled. Once the temperature in the room has been lowered to a desired temperature, the refrigerant capacity of the air conditioning system generally need not be very large in order to handle supplemental cooling because of further temperature changes in the room or for keeping the room at the desired temperature. Accordingly, after the room has cooled down to the desired temperature, the most common technique for controlling the output of the compressor is by intermittent operation of the compressor. However, this intermittent operation of the compressor results in the intermittent application of a relatively large load to the driving mechanism of the compressor in order to drive the compressor.

In automobile air conditioning compressors, the compressor is driven by the engine of the automobile through an electromagnetic clutch. Automobile air conditioning compressors face the same intermittent load problems described above once the passenger compartment reaches a desired temperature. Control of the compressor normally is accomplished by intermittent operation of the compressor through the electromagnetic clutch which couples the automobile engine to the compressor. Thus, the relatively large load which is required to drive the compressor is intermittently applied to the automobile engine.

Furthermore, since the compressor of an automobile air conditioner is driven by the engine of the automobile, the rotation frequency of the drive mechanism changes from moment to moment, which causes the refrigerant capacity to change in proportion to the rotation frequency of the engine. Since the capacity of the evaporator and the condenser of the air conditioner does not change, when the compressor is driven at high rotation frequency, the compressor performs useless work. To avoid performing useless work, prior art automobile air conditioning compressors often are controlled by intermittent operation of the magnetic clutch. However, this again results in a large load being intermittently applied to the automobile engine.

One solution to above mentioned problems is to control the capacity of the compressor in response to refrigeration requirements. One construction to adjust the capacity of a compressor, particularly a wobble plate type compressor, is disclosed in the U.S. Pat. No. 3,861,829 issued to Roberts et al. Roberts et al. discloses a wobble plate type compressor which has a cam rotor driving device to drive a plurality of pistons and varies the slant angle of the slant surface to change the stroke length of the pistons. Since the stroke length of pistons within cylinders is directly responsive to the slant angle of the slant surface, the displacement of compressor is easily adjusted by changing the slant angle. Furthermore, change of the slant angle is accomplished by a pressure difference between a suction chamber and a crank chamber in which the driving device is located.

In such a prior art capacity adjusting mechanism, construction of the refrigeration requirements is complicated and enlarges the outer dimension of the compressor. Also, since a large bore is formed through both the wobble plate and cam rotor for penetration of the drive shaft and for enabling the change of the slant angle, the wobble plate causes useless vibration.

SUMMARY OF THE INVENTION

It is a primary object of this invention to provide an improved refrigerant compressor which has a simple variable angle mechanism for a cam rotor driving device.

It is another object of this invention to provide a refrigerant compressor wherein vibration of a wobble plate is reduced.

It is still another object of this invention to accomplish the above objects with a device that is simple in construction and small in size.

A refrigerant compressor according to this invention includes a compressor housing having a cylinder block with a plurality of cylinders and a crank chamber adjacent the cylinder block. A piston is slidably disposed within each cylinder and is reciprocated by a wobble plate driven by an input cam rotor. The cam rotor has a sloping surface in close proximity to the wobble plate. A drive shaft is connected to the cam rotor and is rotatably supported by the compressor housing. A front end plate, which rotatably supports the drive shaft through a bearing, is disposed in an opening of the crank chamber. A rear end plate, which is disposed at the opposite end of the housing, includes a suction chamber and a discharge chamber for refrigerant. The rear end plate is fixed on the housing together with a valve plate. The crank chamber and the suction chamber are connected by a passage, the opening and closing of which is controlled by a control mechanism.

The cam rotor comprises a rotor member fixed on the drive shaft and a slant plate formed on the sloping surface. The slant plate is connected to the rotor member of a hinge coupling for enabling the variance of the slant angle of the slant plate. The wobble plate has a wobbling center that extends along the axis of drive shaft, and is supported for nutational motion on a ball element fixed to a supporting rod. The supporting rod is slidably disposed in the cylinder block, and is axially movable along the axis of drive shaft.

Further objects, features and other aspects of this invention will be understood from the following detailed description of the preferred embodiments of this invention with reference to the annexed drawings.

DETAILED DESCRIPTION OF THE PREFERRED EMBODIMENT

Figure 1:
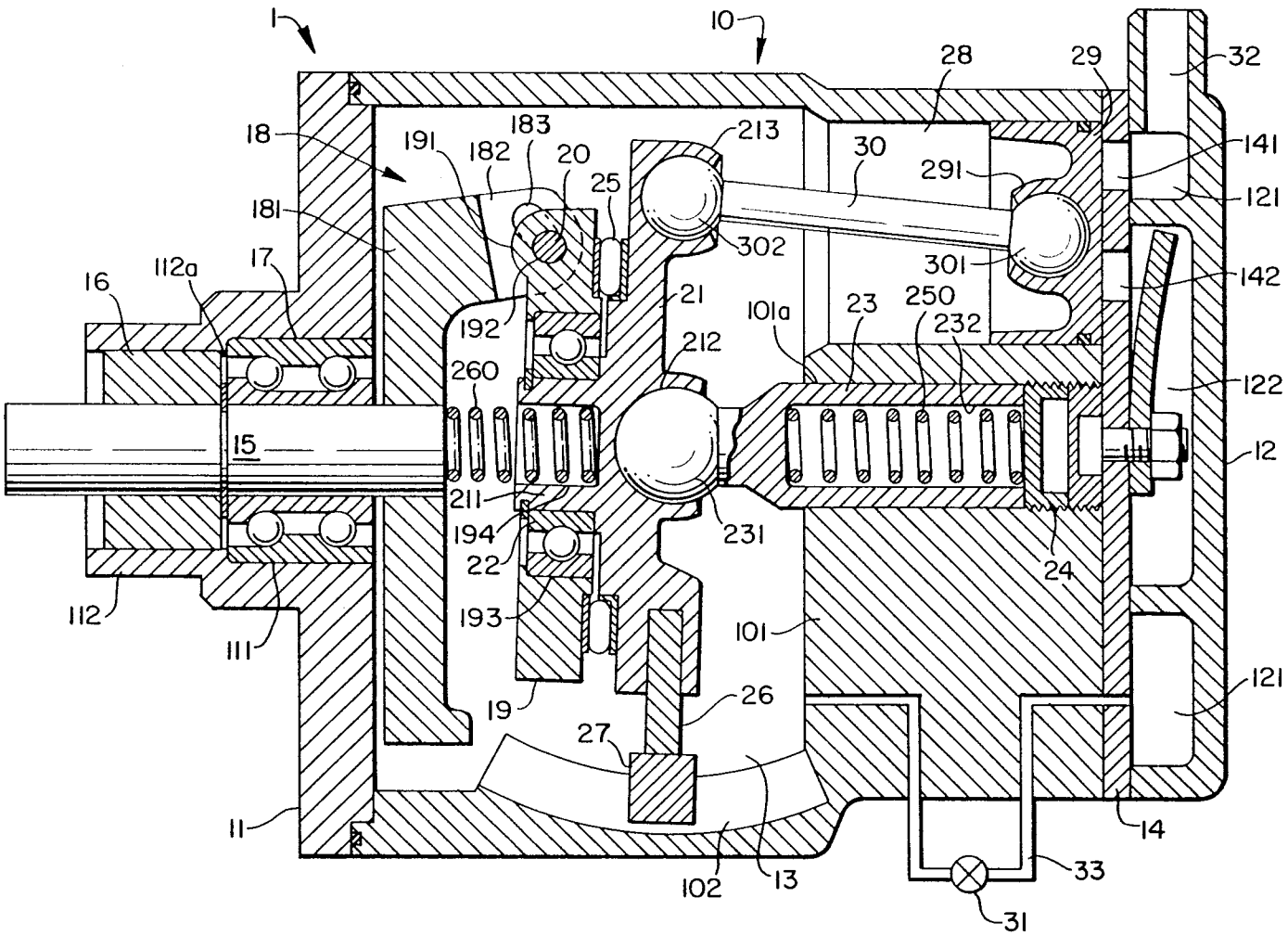
FIG. 1 is a vertical sectional view of a refrigerant compressor according to a preferred embodiment of this invention.

Referring to FIG. 1, a refrigerant compressor according to this invention is shown. The compressor, which is generally indicated by reference number 1, includes a closed cylinder housing assembly 10 formed by cylinder block 101, a hollow portion such as crank chamber 13, a front end plate 11 and rear end plate 12.

Front end plate 11 is mounted on the left end portion of crank chamber 13 by a plurality of bolts (not shown). Rear end plate 12 and a valve plate 14 are mounted on cylinder block 101 by a plurality of bolts (not shown). An opening 111 is formed in front end plate 11 for receiving drive shaft 15. An annular sleeve 112 projects from the front end surface of front end plate 11 and surrounds drive shaft 15 to define a shaft seal cavity 112*a*. A shaft seal assembly 16 is assembled on a drive shaft 15 within shaft seal cavity 112*a*.

Drive shaft 15 is rotatably supported by front end plate 11 through a bearing 17, which is disposed within opening 111. The inner end of drive shaft 15 is provided with a swash plate or cam rotor device 18. The outer end of drive shaft 15, which extends outwardly from sleeve 112, is operatively connected to an engine of a vehicle through a conventional pulley arrangement disposed around the outer portion of sleeve 112.

Cam rotor device 18 comprises a plate body 181 fixed on the inner terminal end of drive shaft 15 and an arm portion 182 axially projecting from plate body 181. A rectangular hole 183 is formed through the outer end portion of arm portion 182. A ring plate member 19 which functions as a slant plate is provided with a slant surface. Ring plate member 19 is coupled with the outer end portion of arm portion 182 through a coupling portion 191 formed on an outer peripheral portion thereof. A penetrating hole 192 is formed through coupling portion 191. A pin 20 is inserted through penetrating hole 192 of coupling portion 191 and rectangular hole 183 of arm portion 182 so that ring plate member 19 is rotatable about pin 20. Ring plate member 19 is thus rotatably coupled to plate body 181. Pin 20 is also slidable along the length of rectangular hole 183. This coupling construction between plate body 181 and ring plate member 19 functions as a hinge mechanism.

The sloping surface of ring plate member 19 is placed in close proximity to the surface of a wobble plate 21 which has an annular axial projection 211 that extends into a central portion 193 formed in ring plate member 19. Ring plate member 19 is rotatably supported on annular axial projection 211 of wobble plate 21 through a bearing 22. Furthermore, wobble plate 21 is supported for nutational but non-rotational motion on a ball portion 231 of ball socket member 23 which is disposed within a central bore 101*a* formed in the central portion of cylinder block 101. That is, a concave portion 212 of wobble plate 21 contacts the outer peripheral surface of ball portion 231 to enable nutational (wobbling), non-rotational movement of wobble plate 21. The axial position of ball socket member 23, which is axially movable within central bore 101*a*, is determined by an adjusting screw 24 screwed into threaded portion of central bore 101*a*, and a coil spring 250 disposed within a blind bore 232 of ball socket member 23 to push ball socket member 23 against the wobble plate 21.

A coil spring 260 is placed between the end surface of plate body 181 and bottom surface of a blind bore 194 formed in the center portion of annular axial projection 211 of wobble plate 21. Thus, wobble plate 21 is usually pushed toward ball socket member 23. Thrust needle bearing 25 is placed between the sloping surface of ring plate member 19 and wobble plate 21 to ensure smooth rotational motion of cam rotor device 18. Since wobble plate 21 rotatably supports slant plate 19 through ball bearing 22, coil spring 260 in effect pushes slant plate 19 toward cylinder block 101 through wobble plate 21.

Figure 2:
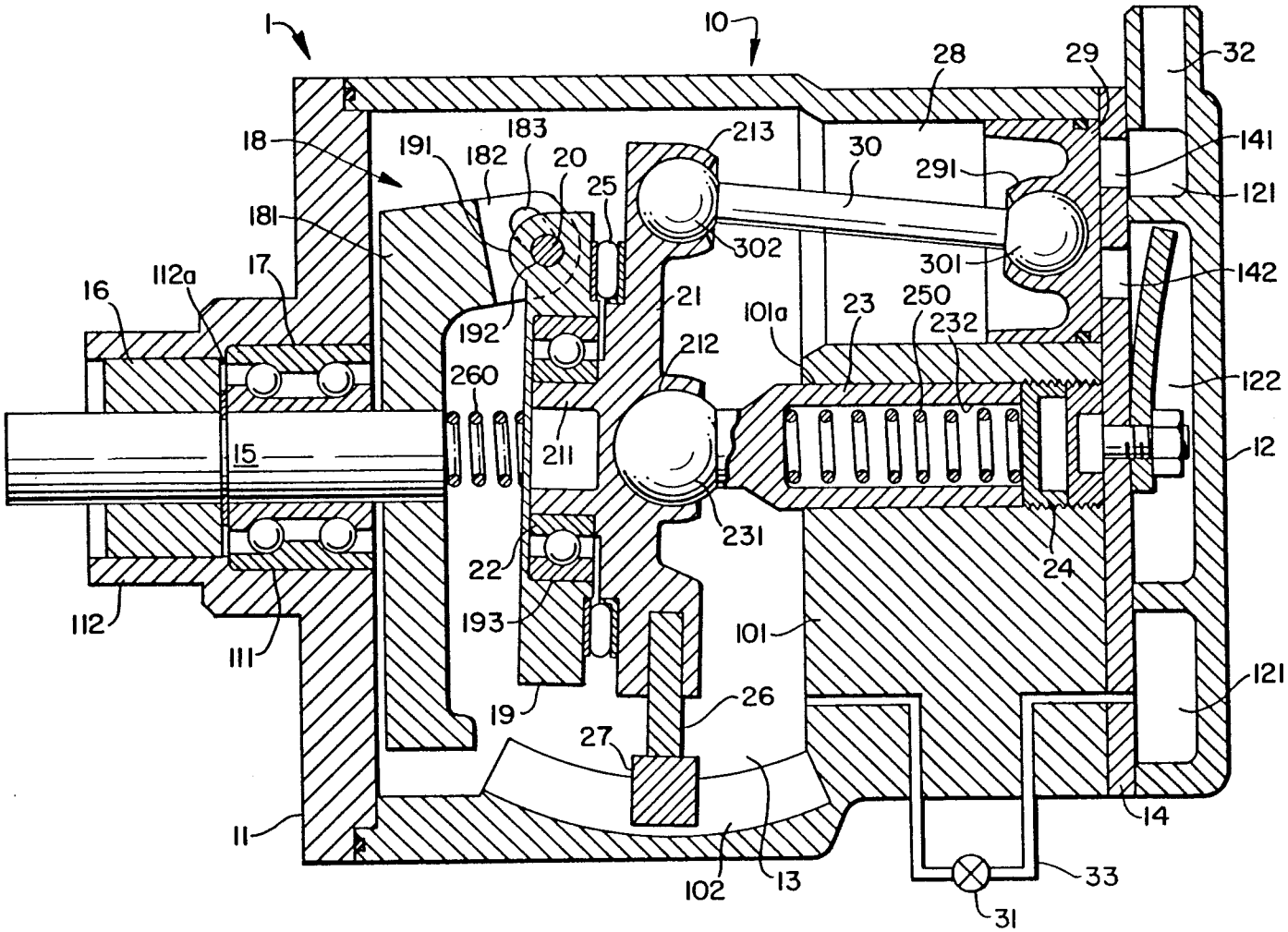
FIG. 2 is a vertical sectional view of a refrigerant compressor according to another embodiment of this invention.

An alternate disposition of spring 260, wherein spring 260 pushes directly against slant plate 19, is shown in FIG. 2. The slant plate 19 in FIG. 2 includes a central portion which extends over annular projection 211 of wobble plate 21, and one end of coil spring 260 bears against this central portion to push slant plate 19 against wobble plate 21.

The rotation of wobble plate 21 is prevented by a guide pin or rod 26 which is fixedly disposed on the bottom end surface thereof. One end of rod 26 extends into longitudinal guide groove 102 formed on the inner peripheral surface of the housing to permit reciprocating motion through a guide member 27.

Cylinder block 101 has a plurality of annularly arranged cylinders 28 into which pistons 29 slide. A typical arrangement includes five cylinders, but a smaller or larger number of cylinders may be provided. All pistons 29 are connected to wobble plate 21 by connecting rods 30. A ball 301 at one end of rod 30 is received in a socket 291 of piston 29 and a ball 302 at the other end of rod 30 is received in a socket 213 of wobble plate 21. It should be understood that, although only one such ball socket connection is shown in FIG. 1, there are a plurality of sockets arranged peripherally around wobble plate 21 to receive the balls of various rods, and that each piston 29 is formed with a socket for receiving the other ball of rod 30.

Rear end plate 12 is shaped to define a suction chamber 121 and a discharge chamber 122. Valve plate 14, which is fastened to the end of cylinder block 101 together with rear end plate 12 by screws, is provided with a plurality of valved suction ports 141 connected between suction chamber 121 and the respective cylinders 28, and a plurality of valved discharge ports 142 connected between discharge chamber 122 and respective cylinders 28. Suitable reed valves for suction ports 141 and discharge ports 142 are described in U.S. Pat. No. 4,011,029 issued to Shimizu.

As shown in FIG. 1, crank chamber 13 is connected with suction chamber 121 through a passageway 33 extending through cylinder block 101 and valve plate 14. The opening and closing of passageway 33 is controlled by magnetic valve means 31 disposed in a midway portion of passageway 33.

In operation, drive shaft 15 is rotated by the engine of the vehicle through a pulley arrangement, and cam rotor device 18 including ring plate member 19 is rotated together with drive shaft 15 to cause non-rotating nutational motion of wobble plate 21 about ball portion 231 of ball socket member 23. Rotating motion of wobble plate 21 is prevented by rod 26 which extends from wobble plate 21 and is slidably fitted into sliding groove 102 through guide member 27. As wobble plate 21 nutates, pistons 29 reciprocate out of phase in their respective cylinders 28. Upon reciprocation of pistons 29, the refrigerant gas, which is introduced into suction chamber 121 from a fluid inlet port 32 formed on rear end plate 12, is taken into each cylinder 28 through suction port 141 and compressed. The compressed refrigerant is discharged to discharge chamber 122 from each cylinder 28 through discharge port 142, and therefrom into an external fluid circuit, for example, a cooling circuit, through a fluid output port (not shown).

During operation of the compressor, if magnetic valve means 31 is operated to open passageway 33, the pressure in crank chamber 13 is maintained at suction pressure, because crank chamber 13 communicates with suction chamber 121 through passageway 33. In this condition, during the compression stroke of the pistons, reaction force of gas compression normally acts against wobble plate 21. The resultant force of that reaction is received by the hinge coupling connecting plate body 181 to ring plate member 19. That is, a moment ($M_1$) which rotates the wobble plate is caused by the reaction gas force acting on the pistons and against the hinge coupling. A moment $M_2$ is caused by the difference in recoil strengths between coil springs 250 and 260; and a moment $M_3$ is caused by a pressure difference between crank chamber 13 and suction chamber 121. Thus, when passageway 33 is open and no pressure difference exists between crank chamber 13 and suction chamber 121, only moment $M_2$ is opposed to moment $M_1$. Therefore, if the recoil strength of both coil springs 250 and 260 is set to achieve $M_1$ greater than $M_2$, ring plate member 19 moves toward plate body 181. Thus, coupling portion 191 of ring plate member 19 is pushed upwardly of rectangular hole 183. and the slant angle of ring plate member 19 is maximized relative to the vertical plane through pin 20. The maximum slant angle results in the maximum stroke of pistons 19 within cylinder 28 which corresponds to the normal refrigeration capacity of the compressor.

On the other hand, if passageway 33 is closed by magnetic valve means 31, the pressure in crank chamber 13 is gradually raised and a narrow pressure difference occurs between crank chamber 13 and suction chamber 121 because blow-by gas, which leaks from the cylinder chambers to crank chamber 13 through a gap between the pistons and cylinders during the compression stroke, is contained in crank chamber 13. During the rising of pressure in crank chamber 13, moment $M_3$ is generated and rises in magnitude in response to the rising of pressure in crank chamber 13. This moment $M_3$ is opposed to the moment $M_1$ so that at some point, the total magnitude of moments $M_2$ and $M_3$ exceed the moment $M_1$. When this occurs, a moment in a counterclockwise direction about the hinge coupling acts against the ring plate member 19 so that the slant angle of ring plate member 19 decreases. Decreasing the slant angle continues until pin 20 contacts the lower end portion of rectangular hole 183. As the slant angle decreases, the stroke of the piston in the cylinder is reduced and the capacity of the compressor gradually decreases. Since it is undesirable to completely stop movement of the pistons because the flow of refrigerant gas and lubricating oil would also stop, some movement of the pistons should be maintained to continue lubrication of the compressor.

As mentioned above, in this invention, the cam rotor device comprises a plate body and ring plate connected by a hinge coupling that enables the slant angle of the ring plate to be varied, and the wobble plate is supported nutational (wobbling) motion on the ball joint mechanism which fixes the location of the wobbling center. Therefore, a simple construction for varying the slant angle is accomplished and is contained within a small size compressor. Also, the wobbling center of the wobble plate is maintained by the ball joint supporting mechanism so that useless vibration of the wobble plate is prevented.

Although the invention has been described in detail in connection with preferred embodiments, it will be understood by those skilled in the art that these embodiments are only for illustration. Various modifications may be made therein by one skilled in the art without departing from the scope or spirit of this invention, which is only limited by the appended claims.

I claim:

1. In a refrigerant compressor including a compressor housing having a cylinder block provided with a plurality of cylinders and a crank chamber adjacent said cylinder block, a piston slidably fitted within each of the cylinders, a driving mechanism including a wobble plate for reciprocating the pistons, an input drive rotor and a drive shaft connected to said input rotor to drive said input drive rotor, a front end plate on said compressor housing for rotatably supporting said drive shaft, a rear end plate disposed on the opposite end of the compressor housing having a suction chamber and a discharge chamber, said wobble plate having a first side facing said front end plate and a second opposite side facing said rear end plate, the crank chamber and the suction chamber connected by a passageway and control means for controlling the opening and closing of the passageway, the improvement comprising said driveshaft extending into said crank chamber and terminating at an inner terminal end on said first side of said wobble plate, said input drive rotor having a rotor member fixed on said inner terminal end of said drive shaft, a slant plate formed with a sloping surface in close proximity to said wobble plate, said wobble plate having a annular boss at its center portion extending into a central bore formed through a center portion of said slant plate, a bearing being disposed in a gap between said central bore and said annular boss for rotatably supporting said slant plate on said wobble plate, hinge means for hinging said slant plate to said rotor member in a manner to vary the slant angle thereof, and a supporting member axially slidable in said cylinder block and coupled to said second side of said wobble plate to support said wobble plate for nutational motion.

2. In a refrigerant compressor including a compressor housing having a cylinder block provided with a plurality of cylinders and a crank chamber adjacent said cylinder block, a piston slidably fitted within each of the cylinders, a driving mechanism including a wobble plate for reciprocating the pistons, an input drive rotor and a drive shaft connected to said input rotor to drive said input drive rotor, a front end plate on said compressor housing for rotatably supporting said drive shaft, a rear end plate disposed on the opposite end of the compressor housing having a suction chamber and a discharge chamber, said wobble plate having a first side facing said front end plate and a second opposite side facing said rear end plate, the crank chamber and the suction chamber connected by a passageway and control means for controlling the opening and closing of the passageway, the improvement comprising said drive shaft extending into said crank chamber and terminating at an inner terminal end on said first side of said wobble plate, said input drive rotor having a rotor member fixed on said inner terminal end of said drive shaft, a slant plate formed with a sloping surface in close proximity to said wobble plate, hinge means for hinging said slant plate to said rotor member in a manner to vary the slant angle thereof, a supporting member axially slidable in said cylinder block and coupled to said second side of said wobble plate to support said wobble plate for nutational motion, said rotor member including an arm portion axially extending from it and a rectangular shaped hole formed through an outer end portion of said arm portion, said slant plate including a coupling portion adjacent said arm portion, a pin hole formed in said coupling portion, and a pin extending into said pin hole and said rectangular hole to connect said rotor member and said slant plate and enable rotating movement of said slant plate about said pin and sliding movement of said pin along the length of said rectangular hole.

3. The refrigerant compressor of claim 2 wherein a first elastic element pushes said slant plate against said wobble plate and a second elastic member pushes said supporting member against said wobble plate.

4. The refrigerant compressor of claim 3 wherein said first and second elastic elements are coil springs.

5. The refrigerant compressor of claim 2 wherein a first elastic element pushes said wobble plate toward said cylinder block, and a second elastic element pushes said supporting member against said wobble plate.

6. The refrigerant compressor of claim 5 wherein said first and second elements are coil springs.

7. The refrigerant compressor of claim 1 wherein said slant plate is rotatably supported on said wobble plate through a bearing.

8. The refrigerant compressor of claim 7 wherein said wobble plate has an annular boss at its center portion extending into a central bore formed through a center portion of said slant plate, and said bearing is disposed in a gap between said central bore and said annular boss to rotatably support said slant plate on said wobble plate.

* * * * *